US006759583B2

(12) United States Patent
Mizuno et al.

(10) Patent No.: US 6,759,583 B2
(45) Date of Patent: Jul. 6, 2004

(54) PERCUSSION INSTRUMENT STICK

(75) Inventors: Masaki Mizuno, Seto (JP); Tomonori Ishizuka, Seto (JP); Hiromi Kajiyama, Seto (JP); Yuichiro Miura, Seto (JP); Tomoaki Yoshinaga, Seto (JP)

(73) Assignee: Hoshino Gakki Mfg. Co. Ltd. (JP)

( * ) Notice: Subject to any disclaimer, the term of this patent is extended or adjusted under 35 U.S.C. 154(b) by 0 days.

(21) Appl. No.: 10/387,017

(22) Filed: Mar. 11, 2003

(65) Prior Publication Data

US 2004/0025666 A1 Feb. 12, 2004

(30) Foreign Application Priority Data

Aug. 7, 2002 (JP) ..... 2002-230219

(51) Int. Cl.[7] ..... G10D 13/02

(52) U.S. Cl. ..... 84/422.4

(58) Field of Search ..... 84/422.1, 422.2, 84/422.3, 422.4

(56) References Cited

U.S. PATENT DOCUMENTS 5,447,088 A * 9/1995 Mester ..... 84/422.4
5,503,056 A 4/1996 Evans ..... 84/422.4
6,271,451 B1 * 8/2001 Gress ..... 84/422.4

* cited by examiner

*Primary Examiner*—Kimberly Lockett
(74) *Attorney, Agent, or Firm*—Ostrolenk, Faber, Gerb & Soffen, LLP

(57) ABSTRACT

A stick for beating a percussion instrument. The instrument has an elastic component. A part of the stick forms a handle used for holding the stick. The elastic component is a part of the handle.

10 Claims, 8 Drawing Sheets

PERCUSSION INSTRUMENT STICK

BACKGROUND OF THE INVENTION

The present invention relates to a stick for a percussion instrument. More particularly, the present invention relates to a stick for a percussion instrument, which stick includes an elastic body.

Known sticks used to beat a percussion instrument, such as a drum, are normally made of hard wood, such as oak or hickory, or made of fiber reinforcement resin. A typical stick has a grip, which is defined on one end of the stick. A drummer holds the grip between the thumb and index finger. The remaining three fingers are gently wrapped around the stick to support the stick. The basal end of the stick (grip end) is supported in the palm, near the drummer's wrist. The drummer beats the percussion instrument by swinging the stick up and down.

When the drummer beats the drum, the impact, between the stick and beating surface of the drum, produces a force, which is received by the drummer through the stick. The impact may hurt the drummer's wrist. More specifically, the grip end, which is made of hard wood, hits the palm near the wrist when the drummer beats the drum with the stick. This may cause fatigue or pain. Professional drummers, who practice every day for long hours, may experience physical problems, such as tenosynovitis.

U.S. Pat. No. 5,503,056 describes a stick having a structure, in which a coil spring is disposed between a grip (handle) and a tapping portion (tip), which is defined at a distal end of the stick. The tapping portion moves elastically relative to the grip. The stick enables an elastic beating of a drum.

However, in the above stick, the spring is located closer to the tapping portion on the tip of the stick, than to the position where the drummer's thumb and index finger hold the stick. Thus, it is difficult to finely control the beating of the drum when using this stick. Accordingly, an elastic body of the stick is normally locked when beating a drum. That is, the above stick does not have a structure that absorbs impacts applied at the tip of the stick while finely controlling the beating of the drum.

BRIEF SUMMARY OF THE INVENTION

Accordingly, it is an object of the present invention to provide a percussion instrument stick that absorbs impacts applied to a drummer's wrist.

In order to achieve above objects, the present invention provides a stick for beating a percussion instrument having an elastic component, wherein a part of the stick forms a handle used for holding the stick, and wherein said elastic component is a part of said handle.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A first embodiment of the present invention will be described with reference to FIGS. 1 to 3.

Figure 2:
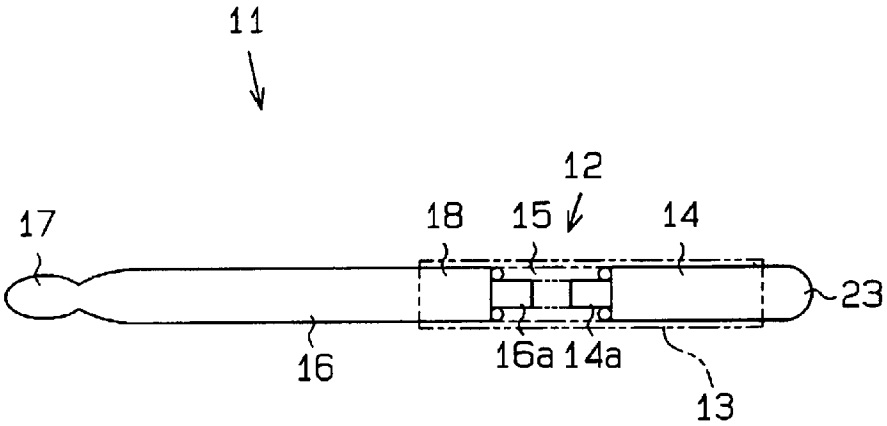
FIG. 2 is a cross-sectional view of the stick illustrated in FIG. 1.
Figure 1:
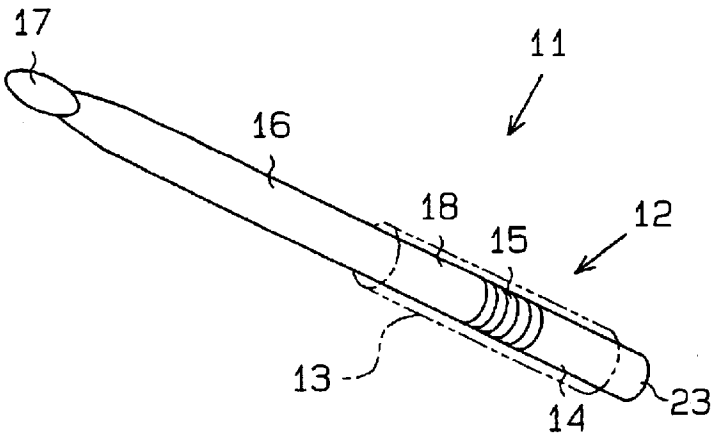
FIG. 1 is a perspective view showing a percussion instrument stick according to an embodiment of the present invention.

Referring to FIGS. 1 and 2, a long, rod-like stick 11 has a length of about 40 cm. The stick 11 is made of hickory and includes a basal component 14, an elastic component (which is elastic connection 15), and a shaft 16. The elastic connection 15, includes an elastic body (e.g., a coil spring).

The basal component 14, which is made of wood and is generally cylindrical, has an axial length of 5 cm. A first protrusion 14*a* protrudes from the distal end surface of the basal component 14. The shaft 16 is formed as a separate body from the basal component 14. The shaft 16 has a round cross section and is made of the same material (e.g., hickory) as the basal component 14. A second protrusion 16*a*, which is has a similar shape as the first protrusion 14*a*, protrudes axially from the basal end surface of the shaft 16. Further, the diameter of the shaft 16 is less towards the distal end of the shaft 16. A tapping portion 17 having an oval cross-section is formed at the distal end of the shaft 16.

The elastic connection 15 is arranged between the basal component 14 and the shaft 16 to elastically connect the basal component 14 with the shaft 16. The elastic connection 15 may be formed of a coil spring. The outer diameter of elastic connection 15 is equal to the outer diameters of the basal component 14 and the shaft 16, and the elastic connection 15 has an axial length of 3 cm. The two ends of coil spring of the elastic connection 15 are engaged with the protrusions 14*a*, 16*a* to connect the basal component 14 to the shaft 16. In the elastic connection 15 according to the first embodiment, the coil spring has a spring constant of 3.15N/mm, a wire diameter of Ø 1.6 mm, and is made of stainless steel.

In the first embodiment, a predetermined adhesive is applied to the protrusions 14*a* and 16*a* to secure the coil spring of the elastic connection 15 to the protrusions 14*a*, 16*a*. This reinforces the connection between the elastic connection 15 and the protrusions 14*a*, 16*a*.

The total axial length of the first and second protrusions 14*a*, 16*a* is shorter than the axial length of the elastic connection 15. Accordingly, the coil spring of the elastic connection 15 deforms elastically and freely.

The basal component 14, the elastic connection 15, and the shaft 16 are coaxially connected in a normal state, which is shown in FIGS. 1 to 4.

There are two ways to grip a stick, matched grip and regular grip. In either way, the stick is held at substantially the same points. A case where a drummer uses the matched grip to hold the stick, will now be described. However, the present invention is not limited to the matched grip.

Figure 3A:
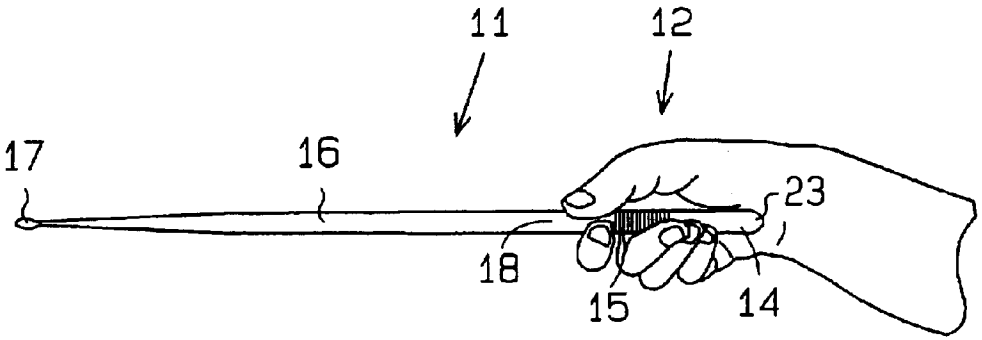
FIG. 3A is a perspective view showing the stick of FIG. 1 in a gripped state.
Figure 3B:
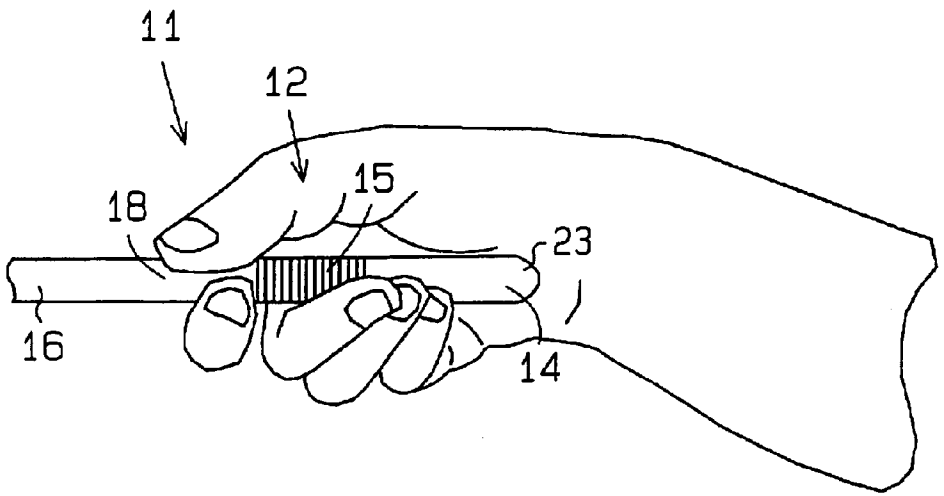
FIG. 3B is an enlarged perspective view showing the vicinity of a handle of the stick of FIG. 3A.

FIGS. 3A and 3B show the matched grip. In the matched grip, the drummer holds a handle 12 of the stick 11 with the right and left hand between the thumb and index finger. The remaining three fingers gently wrap and contact the handle 12 from below. The palm, which is near the wrist, comes in contact with the handle 12. When beating a drum with the matched grip, the drummer holds the stick 11 between the thumb and index finger at a holding position 18, which is usually spaced from the basal end of the stick 11 by 11 to 14 cm. Further, the drummer's palm contacts the stick 11 at a contact position 23 of the handle 12. The contact position 23 is located near the basal end of the stick 11.

The elastic connection 15 is arranged between the holding position 18 and the basal end of the stick 11. The basal component 14 moves elastically relative to the shaft 16 about the elastic connection 15 when the stick 11 is swung vertically to beat the drum. Therefore, impacts produced when beating the drum with the tapping portion 17 are absorbed and transmitted to the basal component 14 through the elastic connection 15.

Further, the holding position 18, at which the drummer holds the stick between the thumb and index finger, is located near the distal end of the elastic connection 15. Accordingly, the drummer may beat the drum without being affected by the elastic force of the elastic connection 15 that is applied to the drummer's hand when beating the drum. This enables the drummer to finely control the beating force.

The handle 12 refers to the portion where the drummer holds the stick 11 and is defined by the basal component 14, the elastic connection 15, and a part of the proximal side of the shaft 16.

The stick 11 has a cylindrical sleeve or a stick cover 13, which is formed separately from the stick 11. The stick cover 13 serves as a member to reinforce connected portions. The stick cover 13 is made of rubber and has a length of 16.5 cm. The inner diameter of the stick cover 13 is generally equal to the outer diameter of the stick 11. The stick cover 13 has a ring-like cross section. The stick cover 13 is fitted to the stick 11 to cover the outer circumferential surfaces of the shaft 16 and the basal component 14. This reinforces the connection between the basal component 14, the elastic connection 15 and the shaft 16.

The stick cover 13 is fastened to the stick 11 such that it does not move along the stick 11 during normal usage. The stick cover 13 is removed from the stick 11 by pulling the stick cover 13 off the stick 11.

When the drummer beats a percussion instrument, such as a snare drum, with the stick 11, the drummer first swings up the stick.

More specifically, the drummer uses the elbow as a fulcrum to raise the forearm. Accordingly, the stick 11 is raised to a height that is optimal for starting the down swing of the stick.

The drummer's forearm moves at a relatively slow and constant speed to prepare for the movement of the wrist.

Then, the drummer starts moving the wrist together with the forearm. Therefore, the movement of the forearm about the elbow and the movement of the wrist apply forces to the stick 11. The movement of the wrist pivots the stick 11 about the holding position at a certain angular acceleration.

Accordingly, the basal component 14 pivots about the holding position 18 at a velocity that is proportional to the distance from the holding position 18. In view of the velocity, it is preferred that the ratio of the distance between the holding position 18 and the distal end of the stick, to the distance between the holding position 18 and the basal end be from 6:3 to 7:3. When that ratio is 6:3, the moving distance of the basal end is X when the movement distance of the distal end in the vertical direction is 2×. For example, when a stick having an axial length of 40 cm pivots about a holding position 18 by 40 degrees, a distal end of the stick vertically moves by about 19 cm and a basal end moves by about 9.5 cm.

Since the stick 11 of the present invention has the elastic connection 15 in the handle 12, the basal component 14 elastically moves relative to the shaft 16. The three remaining fingers gently wrap the handle 12 from below to support the stick 11 and the palm supports the basal component 14 near the wrist.

Accordingly, acceleration is applied to the basal component 14 when the drummer swings the stick 11 up. This produces a downward force about the holding position 18. However, the basal component 14 remains held in the fingers of the drummer at a predetermined position. As a result, the stick 11 is swung up stably in a state applying pressure to the palm near the wrist.

In this state, the tapping portion 17 moves upward, pivoting about the holding position while the basal component 14 is held in the drummer's hand near the wrist. This elastically bends the elastic connection 15.

The tapping portion is moved upward to a predetermined position and is then moved downward about the elbow. The movement produces angular acceleration about the drummer's elbow. As a result, the stick 11 is angularly accelerated as it moves downward during a period from when the stick 11 starts moving to when the stick 11 beats the snare drum, since the stick 11 is spaced from the drummer's elbow by a predetermined distance.

Further, the drummer starts moving the stick downward about the wrist in reaction to the above downward movement. Therefore, the force produced by the downward movement about the wrist and the downward movement about the elbow is applied to the stick. This moves the stick 11 about the holding position 18 at a certain angular acceleration.

When the drummer starts swinging the stick 11 downward after swinging it upward, the elastic force of the deformed elastic connection 15 acts on the stick 11 and applies a further downward force to the stick. That is, the elastic force of the elastic connection 15 acts to move the tapping portion 17 downward about the elastic connection 15.

Accordingly, when the drummer swings the stick 11 downward, the drummer's downward swinging force and the elastic force of the elastic connection 15 are applied to the stick 11. Then, the elastic connection 15 gradually returns to a normal state.

When the drummer swings the stick 11 downward, an upward force is applied to the basal component 14 about the holding position 18. Further, the basal component 14 is held in the drummer's hand near the wrist at the predetermined position. As a result, the stick 11 is swung down stably, in a state applying pressure to the palm near the wrist.

In this state, the tapping portion 17 moves downward pivoting about the holding position while the basal component 14 is held in the drummer's hand near the wrist. This elastically bends the elastic connection 15.

As the entire stick 11 moves down, due to the downward swinging of the stick 11, the tapping portion 17 beats the snare drum. In a normal stick, the beating impact is transmitted to the basal component 14 through the tapping portion 17 and the shaft 16. However, in the stick 11 according to the present invention, the elastic connection 15 includes a coil spring, which is arranged between the shaft 16 and the basal component 14. Therefore, the elastic connection 15 absorbs a significant amount of the beating impact produced by the tapping portion 17 that is transmitted to the basal component 14. In addition, the basal component 14, wrapped in the drummer's fingers, is supported stably near the wrist.

Subsequently, the drummer starts swinging the stick 11 upward again. When the stick 11 is swung upward after swinging it downward, the elastic force of the elastic connection 15, which is elastically deformed by the downward swinging of the stick 11, is applied to the stick 11. The drummer beats and plays the snare drum by repeatedly swinging the stick 11 upward and downward, as described above.

Figure 4A:
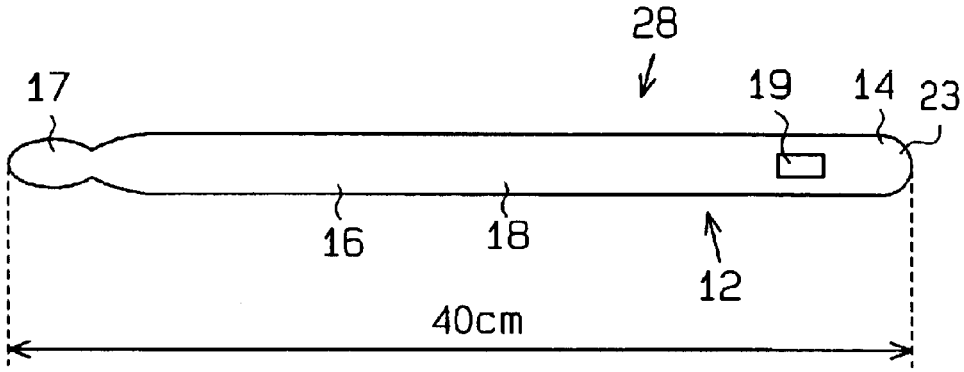
Fig.4A(Prior Art)
FIG. 4A is a perspective view showing a prior art stick.
Figure 4B:
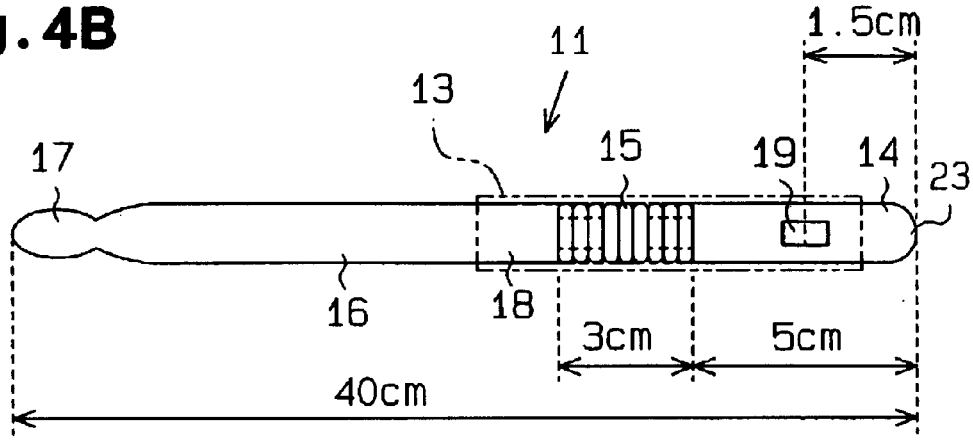
FIG. 4B is a perspective view showing a stick according to the first embodiment of FIG. 1, but modified with the attachment of an acceleration sensor.
Figure 4C:
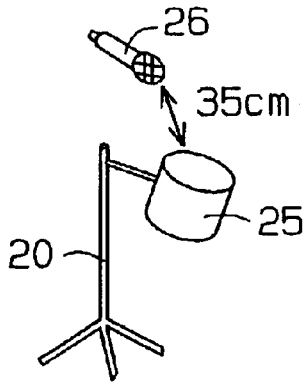
FIG. 4C is a perspective view schematically showing the arrangement of equipment that was used in an experiment.

The results of an experiment that was conducted, as shown in FIG. 4, will now be described. The experiment was conducted using a prior art stick 28 shown in FIG. 4A and the stick 11 of the present invention shown in FIG. 4B. Each of the sticks 11, 28 included an acceleration sensor 19 arranged at a position 1.5 cm away from the distal end of the stick. The stick cover 13 was fitted to the stick. A tam-tam 25 was attached to a stand 20, and a microphone 26 was arranged spaced from the tam-tam 25 by 35 cm.

In the experiment, the sticks 11, 28 each beat the tam-tam 25 as measurements were collected from the acceleration sensor 19 and the microphone 26, which was used to measure the sound level.

Figure 5A:
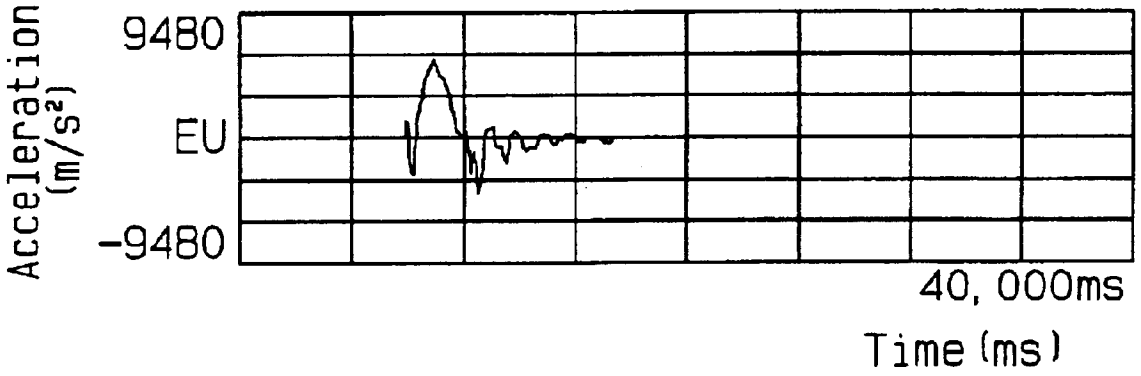
FIG. 5A is a graph showing experimental data of acceleration of the prior art stick of FIG. 4A.
Figure 5B:
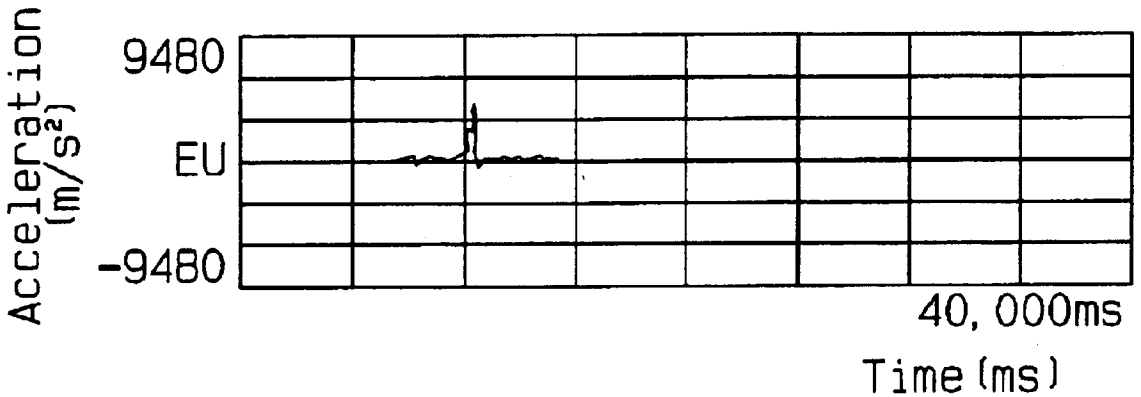
FIG. 5B is a graph showing experimental data of acceleration of the stick of the present invention, as shown in FIG. 4B.
Figure 6A:
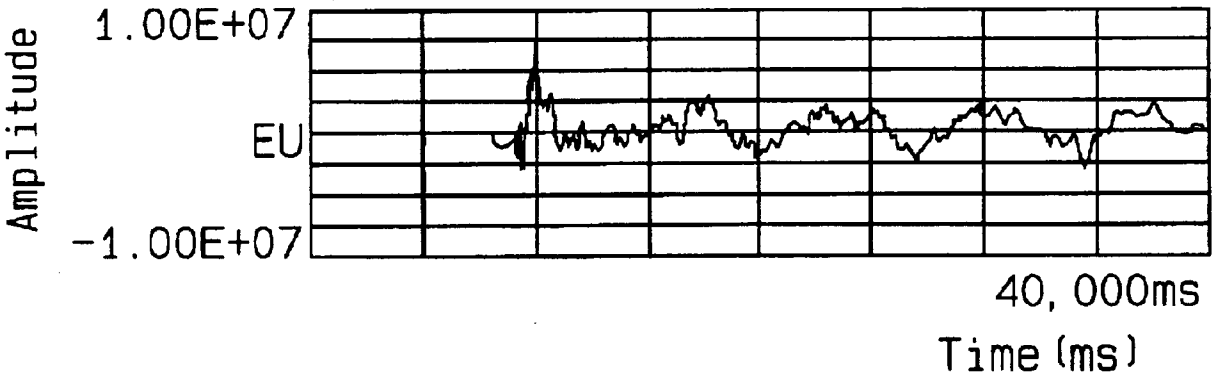
FIG. 6A is a graph showing data of the amplitude of the sound produced by the prior art stick of FIG. 4A.
Figure 6B:
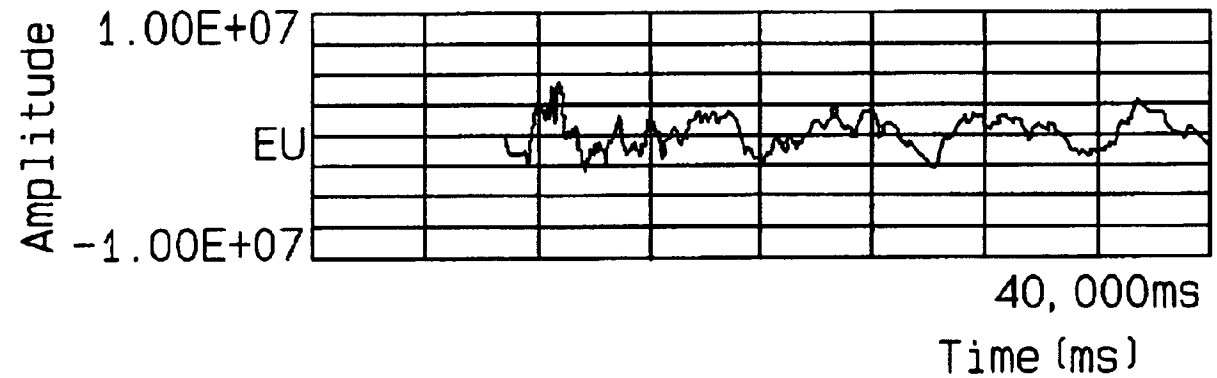
FIG. 6B is a graph showing data of the amplitude of the sound produced by the stick of the present invention, as shown in FIG. 4B.

FIGS. 5A, 5B, 6A, and 6B show the experimental data. FIGS. 5A and 5B are graphs showing representative data obtained from the acceleration sensor 19. The horizontal axis of the graph indicates time, while the vertical axis indicates acceleration. In FIGS. 5A and 5B, positive acceleration indicates acceleration in a downward direction, while negative acceleration indicates acceleration in an upward direction. FIGS. 6A and 6B are graphs showing representative data obtained from the microphone 26. The horizontal axis of the graph indicates time, while the vertical axis indicates a magnitude of amplitude. The level of sound emitted by the tam-tam 25 is indicated based on the magnitude of the amplitude. FIGS. 5A and 6A show the measured results of the prior art stick 28, and FIGS. 5B and 6B show the measured results of the stick 11 of the present invention.

As a result, the amplitude of the sound produced by the sticks 11, 28 were substantially the same. This indicates that the beating strength of the stick 11 of the present invention is finely controlled like when using the prior art stick 28.

The acceleration of each stick obtained by the acceleration sensor will now be described. When using the prior art stick 28, the acceleration was about −2528 m/S2 before beating the tam-tam 25, as shown in FIG. 5A. It is believed that the acceleration at the basal component is obtained from the upward swinging movement about the drummer's (tester's) wrist and the resulting movement about the holding position 18.

When using the stick 11 of the present invention, negative acceleration did not occur before beating the tam-tam 25 (see FIG. 5B). It is presumed that this is because the basal component 14 is always held in the palm near the tester's wrist. That is, it is believed that the basal component 14 is always held in the tester's hand near the wrist and is not affected by the movement about the holding position 18. In addition, it is believed that the basal component 14 is always held near the wrist, which is the center of the swinging movement, and is thus not affected by the movement about the wrist of the tester.

The acceleration of the basal component 14 of each stick when beating the tam-tam 25 will now be described. The acceleration of the prior art stick 28 was about 6004 m/s2 when beating the tam-tam 25 (see FIG. 5(*a*)). On the other hand, the acceleration of the stick 11 of the present invention was about 4108 $m/s^2$ when beating the tam-tam 25, as shown in FIG. 5B. This shows that the acceleration of the basal component 14 of the stick 11 of the present invention is smaller than that of the prior art stick 28. On the other hand, the level of sound is the same in both sticks, as described above. This indicates that in the basal component 14, the acceleration (beating power) of the stick 11 of the present invention is smaller than the acceleration of the prior art stick 28. Further, at the tapping portion 17, the acceleration of both sticks is the same. In other words, the stick 11 of the present invention enables adjustment of the beating power like the prior art stick 28. Additionally, the basal component 14 of the stick 11 of the present invention remains held in the drummer's hand during beating. This enables the stick 11 of the present invention to freely beat a drum without being affected by the elastic force of the elastic connection 15 and elastically moves the basal component 14 relative to the shaft 16 about the elastic connection 15.

The acceleration of the basal component 14 of each stick after beating the tam-tam 25 will now be described. When using the prior art stick 28, the acceleration of the basal component 14 was about −3792 $m/s^2$ immediately after beating the tam-tam 25 and then gradually converged to 0 $m/s^2$ while the acceleration went back and forth between positive and negative values (see FIG. 5A). A slight acceleration was continuously measured for a certain period after the beating when using the stick 11 of the present invention. However, the acceleration is too small to be measured, as shown in the graph of FIG. 5B. This indicates that although the basal component 14 of the stick 28 vibrates vertically, the basal component 14 of the stick 11 hardly vibrates, and the impact, which is produced when the tapping portion 17 beats the tam-tam 25, is not transmitted to the basal component 14. In other words, it is believed that the elastic connection 15 elastically moves relative to the tapping portion 17 and thus absorbs the impact transmitted to the basal component 14.

For this reason, according to the experiment, the use of the stick 11 of the present invention absorbs the impact on the hand of the tester and keeps the stick 11 held stably in the hand. In addition, this enables fine beating control.

As described above, since the elastic connection 15, which serves as an elastic body, is arranged between the shaft 16 and the basal component 14, the basal component 14 moves elastically relative to the shaft 16. Therefore, the impact produced when the drummer beats a drum is transmitted to the basal component 14 after being absorbed by the elastic connection 15. This suppresses fatigue and pain that the drummer suffers from at the palm or wrist. Further, this enables the basal component 14 to be held stably when the drummer swings the stick 11 up and down to beat the drum.

Furthermore, the elastic connection 15 is elastically deformed when swinging the stick up and down. Therefore, the elasticity of the elastic connection 15, produced when the drummer swings the stick, aids the drummer's upward and downward swinging movement.

In addition, the holding position, at which the drummer holds the stick with the thumb and index finger, is defined at the distal end of the elastic connection 15.

Accordingly, the drummer beats a drum without being affected by the elastic force of the elastic connection 15. This enables the drummer to finely control the beating force.

Furthermore, the basal component 14 and the shaft 16 of the stick 11 are formed separately from each other and connected to each other by the elastic connection 15. Therefore, the elasticity of the elastic connection 15 is used more effectively in comparison to when the basal component 14 and the shaft 16 are formed integrally. As a result, the elastic connection 15 effectively absorbs the impacts.

In addition, the stick cover 13 is fitted on the handle 12, which the drummer holds with the hand at the basal end of the stick 11 and which includes the elastic connection 15. This reinforces the connection between the basal component 14 and the shaft 16.

Further, the stick cover 13 entirely covers the elastic connection 15 from the basal component 14 to the shaft 16. This produces the same effect as when increasing the spring constant of the coil spring that is used for the elastic connection.

In addition, since the stick cover is movable along the stick 11, the cover is easily removed from the stick 11. Accordingly, the stick cover 13 may be replaced with a new one when the stick cover 13 is worn and becomes loose. In addition, replacement of the stick cover 13 with a stick cover having a different thickness or hardness produces the same effect as when replacing the coil spring, which is used in the elastic connection 15, with a coil spring having a different spring constant.

In the first embodiment, an adhesive is applied to protrusions 14*a*, 16*a*. In this state, the ends of the elastic connection 15 are engaged with the protrusions 14*a*, 16*a*.

This connects the elastic connection 15 with the first and second protrusions 14*a*, 16*a*. As a result, the connection between the basal component 14 and the shaft 16 is reinforced.

Figure 9A:
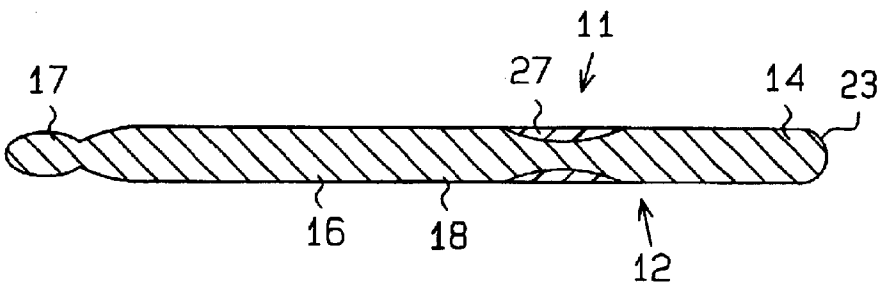
FIG. 9A is a front view showing a stick according to a modification of the first embodiment of the present invention.

Note that while the basal component 14 and the shaft 16 are formed as separate bodies in the first embodiment, these two members can be formed integrally to pass through an elastic component 27 as shown in FIG. 9A. This construction decreases the number of components which constitute a musical instrument stick.

Although the stick cover 13 is used to reinforce the connections between each member, connecting means for connecting the basal component 14 with the shaft 16, for example a clamp, may be used to reinforce the connections. For example, to reinforce the connection between the basal component 14 and the shaft 16, a plurality of piano wires 40 may extend axially through the elastic connection 15, which is formed of a coil spring, in a tense state, as shown in FIG. 9C. In this state, the elastic connection 15 engages protrusions 14*c* and 16*d*. This decreases the number of parts in the stick 11 and reinforces the connection between members.

The stick cover 13 may be made of materials other than rubber, such as resin and carbon fiber. In addition, the stick cover 13 may be omitted.

The coil spring may be made of materials other than stainless, such as resin and carbon fiber.

Second Embodiment

Figure 7:
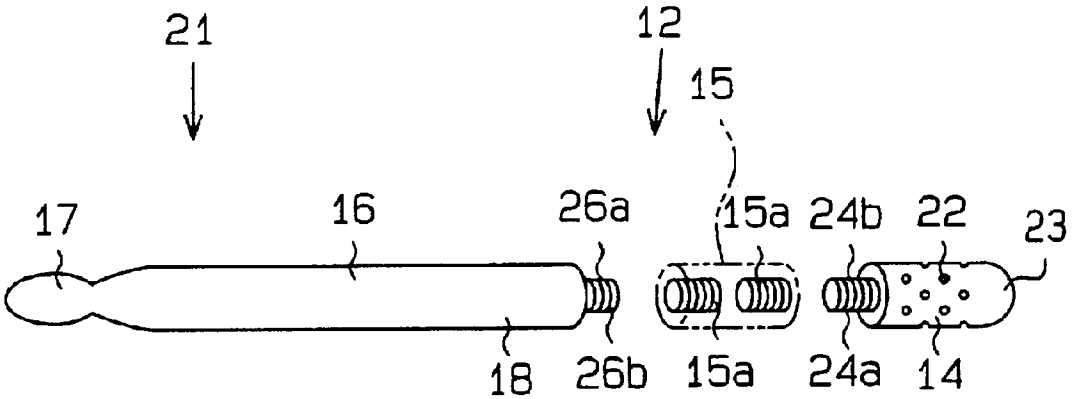
FIG. 7 is a perspective view showing a stick according to a second embodiment of the present invention.

A second embodiment of the present invention will now be described with reference to FIG. 7.

In the following embodiments including the second embodiment, elements that are like to those in the first embodiment are denoted with same reference numbers and will not be described.

A stick 21 includes a basal component 14, an elastic connection 15, and a shaft 16. The basal component 14 is made of a hollow aluminum body and has a plurality of small holes in its surface. In addition, a projection 24*a* extends from the distal end of the basal component 14. The projection 24*a* has threads 24*b* extending along the circumferential surface of the projection 24*a* to mate the basal component 14 and the elastic connection 15.

The elastic connection 15 is made of carbon fiber and has threaded holes 15*a* extending axially from its two ends. A projection 26*a* projects from the basal of the shaft 16. The projection 26*a* has threads 26*b* extending along the circumferential surface of the projection 26*a* to mate the shaft 16 and the elastic connection 15.

Therefore, the basal component 14 and the elastic connection 15 are fastened with each other and the elastic connection 15 and the shaft 16 are fastened with each other to form the stick 21. This enables the stick 21 to be disassembled.

Thus, it is possible to replace each part with new part when the old part ears and does not work well due to long-term use of the stick 21. In addition, this enables a drummer to form a stick 21 having an elastic connection 15 to meet the preference of the drummer in accordance with the hardness of carbon fiber.

Further, in the second embodiment, the basal component 14 is made of aluminum while the shaft 16 is made of hickory. Therefore, the stick 21 may have a weight balance that satisfies individual preferences.

Further, since a plurality of small holes are formed on the surface of the basal component 14, the weight of the basal component 14 may be reduced in addition to increasing the friction coefficient of the basal component 14.

Note that while the basal component 14 and the shaft 16 are formed as separate bodies in the second embodiment, these two members can be formed integrally to pass through the elastic component 27 as shown in FIG. 9A. This construction decreases the number of components which constitute a musical instrument stick.

In the second embodiment, the basal component 14 and the shaft 16 are both removable from the elastic connection 15. However, one of them may be fixed to the elastic connection 15.

Figure 9B:
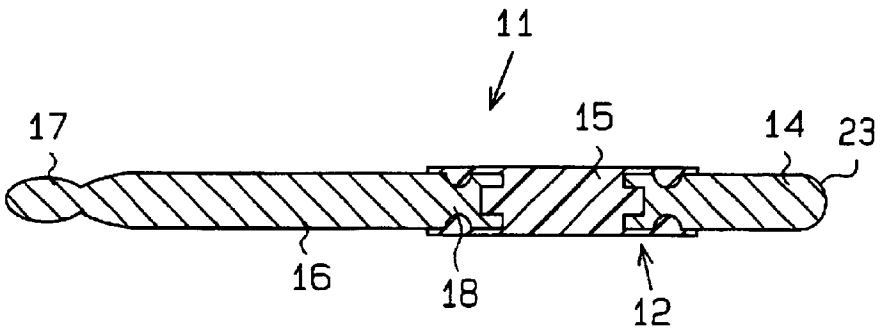
FIG. 9B is a front view showing a stick according to a modification of the first embodiment of the present invention.
Figure 9C:
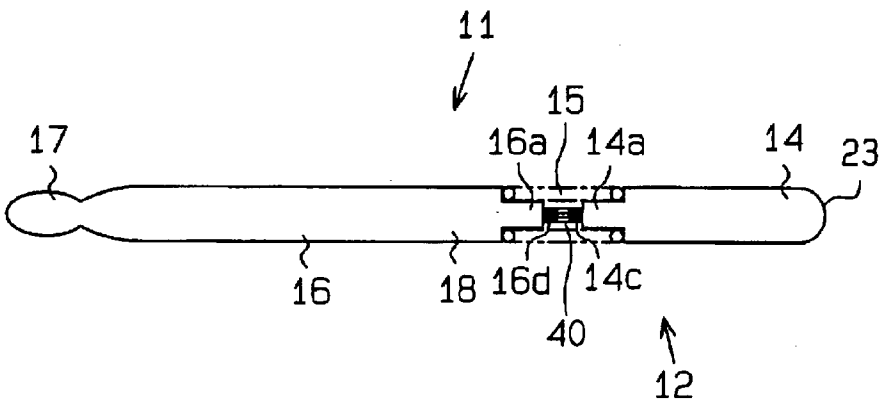
FIG. 9C is a front view showing a stick according to a modification of the first embodiment of the present invention.

In addition, instead of screwing each member to one another, the member may be fitted to each other as shown in FIG. 9B.

The basal component 14 may be formed of materials other than aluminum, such as metal, wood, resin, glass, and ceramic. In addition, the basal component 14 may be formed from an elastic body to absorb the impact on the drummer's wrist.

Third Embodiment

Figure 8:
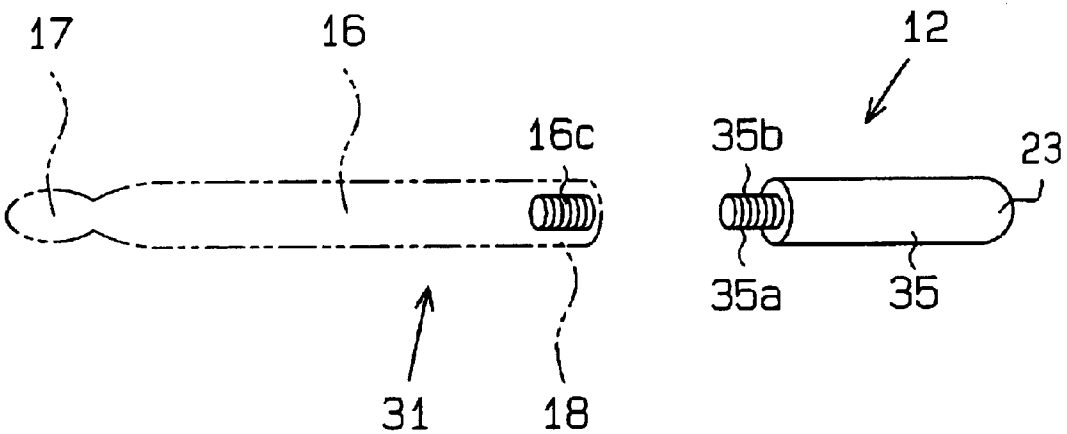
FIG. 8 is a perspective view showing a stick according to a third embodiment of the present invention.

A third embodiment of the present invention will be described with reference to FIG. 8.

A stick 31 of the third embodiment includes a basal elastic piece 35, which functions as the basal component 14 and the elastic connection 15 of the first embodiment. The stick 31 is formed from the basal elastic piece 35 and a shaft 16. The basal elastic piece 35 is made of rubber and has a length of 8 cm. In addition, a projection 35*a* extends from the distal end of the basal elastic piece 35. The projection 35*a* has threads 35*b* extending along the circumferential surface of the projection 35*a* to mate the basal elastic piece 35 and the shaft 16. The shaft 16 includes a thread hole 16*c* in the basal end.

The basal elastic piece 35 and the shaft 16 are fastened with each other to form the stick 31. This enables the stick 31 to be disassembled.

In the third embodiment, the stick 31 is made of only two components, the basal elastic piece 35 and the shaft 16. In comparison to when three components are required, this reduces costs when mass-producing the same components.

The stick 31 has the basal elastic piece 35 and the projection 35*a* integrally formed from rubber at its basal end. Therefore, in comparison to the other embodiments where an elastic body is integrally formed, the basal component of the stick 31 is swung down more stably in the hand of the drummer.

It should be apparent to those skilled in the art that the present invention may be embodied in many other specific forms without departing from the spirit or scope of the invention. Particularly, it should be understood that the present invention may be embodied in the following forms.

The basal elastic piece 35 may be formed of other elastic bodies, such as a coil spring, resin, or carbon fiber.

Figure 10A:
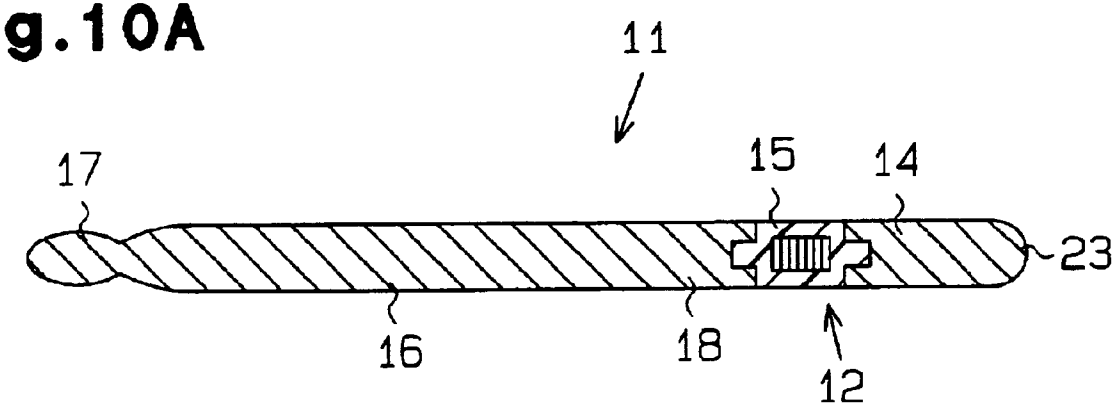
FIG. 10A is a cross-sectional view showing a stick according to a modification of the first and/or second embodiment of the present invention.

The elastic connection 15 or the basal elastic piece 35 is formed of one elastic body. However, the elastic connection 15 or the basal elastic piece 35 may be formed of two or more elastic bodies. For example, the stick may be made of the hollow elastic connection 15, which is made of resin and includes a coil spring, as shown in FIG. 10A.

Figure 10B:
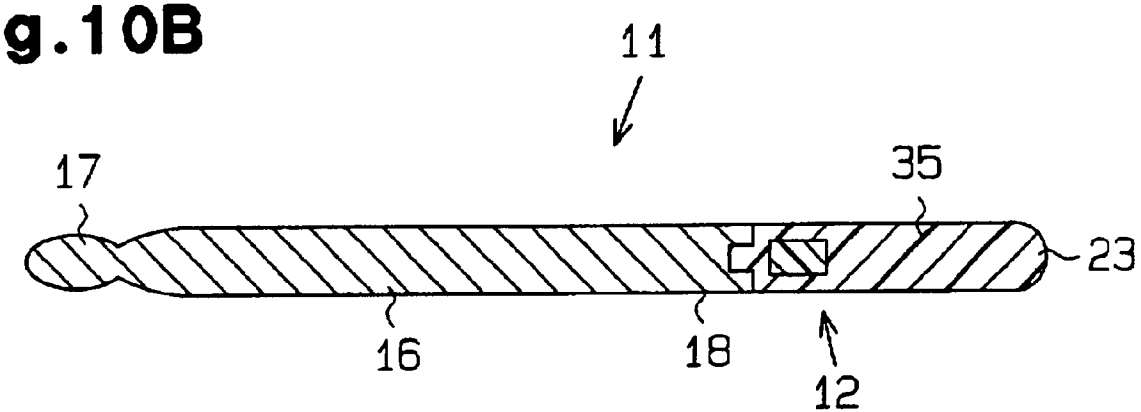
FIG. 10B is a cross-sectional view showing a stick according to a modification of the third embodiment of the present invention.

As shown in FIG. 10B, the stick may be formed of a basal elastic piece 35 made of carbon fiber that has hollow-body part at a distal end, into which rubber is inserted. This produces an effect in that elastic force of the elastic connection 15 and the basal elastic piece 35 at a predetermined position may be adjusted.

In the above embodiments, the present invention is embodied in a stick used for a drum. However, the present invention may be embodied in other percussion instrument sticks, such as sticks for a xylophone, a Japanese drum or, a big drum.

Therefore, the present examples and embodiments are to be considered as illustrative and not restrictive and the invention is not to be limited to the details given herein, but may be modified within the scope and equivalence of the appended claims.

What is claimed is:

1. A stick for beating a percussion instrument, comprising:

a basal component;

a shaft having an end and a tapping portion formed at the end of the shaft; and a handle including an elastic component forming an elastic connection between the basal component and the shaft, the handle being defined by the basal component, the elastic component, and a part of the shaft;

wherein the elastic component is configured to absorb impacts produced when beating the percussion instrument with the tapping portion of the shaft, the elastic component transmitting the impacts to the basal component of the stick.

2. A stick according to claim 1, wherein the basal component and the shaft are detachably connected to each other by the elastic component.

3. A stick according to claim 2, wherein at least one of the basal component and the shaft is screwed to the elastic component.

4. A stick according to claim 2, wherein at least one of the basal component and the shaft is fitted to the elastic component.

5. A stick according to claim 3, wherein the basal component is integrally formed with the elastic component.

6. A stick according to claim 3, further comprising a sleeve covering the elastic component and connected ends of the basal component and the shaft to reinforce the connection between the shaft and the basal component.

7. A stick according to claim 3, wherein the shaft and the basal component are formed of materials different from each other.

8. A stick according to claim 3, wherein the elastic component includes a plurality of elastic bodies.

9. A stick according to claim 3, wherein a plurality of pores are formed in at least one of the basal component and the elastic component.

10. A stick according to claim 1, wherein the basal component is a hollow body.

* * * * *